US009905067B2

(12) United States Patent
McIntyre et al.

(10) Patent No.: US 9,905,067 B2
(45) Date of Patent: Feb. 27, 2018

(54) AUTOMOBILE POWER WINDOW ENABLE AND DISABLE METHOD

(71) Applicant: Continental Automotive Systems, Inc., Auburn Hills, MI (US)

(72) Inventors: Matthew D. McIntyre, New Baltimore, MI (US); Christin L. Broski, Shelby Township, MI (US); Yasser Gad, Macomb, MI (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 0 days.

(21) Appl. No.: 13/725,471

(22) Filed: Dec. 21, 2012

(65) Prior Publication Data

US 2014/0176300 A1 Jun. 26, 2014

(51) Int. Cl.

| | |
|---|---|
| ***G07C 9/00*** | (2006.01) |
| ***E05F 15/40*** | (2015.01) |
| ***E05F 15/695*** | (2015.01) |

(52) U.S. Cl.

CPC ..... *G07C 9/00571* (2013.01); *E05F 15/40* (2015.01); *E05F 15/695* (2015.01); *E05Y 2400/854* (2013.01); *E05Y 2400/86* (2013.01); *E05Y 2800/426* (2013.01); *E05Y 2800/73* (2013.01); *E05Y 2900/55* (2013.01)

(58) Field of Classification Search

CPC ..... B60R 25/20; B60R 25/30; G07C 9/00309; G07C 9/00571; E05Y 2400/854

USPC ..... 340/5.7, 5.61, 3.1, 4.62; 307/10.1

See application file for complete search history.

(56) References Cited

U.S. PATENT DOCUMENTS

| | | | | |
|---|---|---|---|---|
| 5,187,381 | A * | 2/1993 | Iwasa et al. | 307/10.1 |
| 6,051,945 | A * | 4/2000 | Furukawa | 318/280 |
| 6,925,427 | B1 * | 8/2005 | Montgomery | 703/13 |
| 6,944,528 | B2 * | 9/2005 | Nagano | 701/49 |
| 2010/0235057 | A1 * | 9/2010 | Papanikolaou | E05B 81/14 701/49 |

FOREIGN PATENT DOCUMENTS

DE 102007024887 A1 1/2009

OTHER PUBLICATIONS

International Search Report and Written Opinion dated Feb. 11, 2014, from corresponding International Patent Application No. PCT/US2013/077148.

* cited by examiner

*Primary Examiner* — Vernal Brown

(57) ABSTRACT

A method, apparatus and system for controlling the actuation of a movable structure, the moveable structure configured to open and close an aperture in a vehicle, is disclosed. The method comprises receiving a sequence containing a request to at least one of open and close the aperture, interpreting the sequence as a request to one of enable and disable the actuation of the moveable structure, and in response to the interpretation, one of enabling and disabling the actuation of the moveable structure.

21 Claims, 5 Drawing Sheets

AUTOMOBILE POWER WINDOW ENABLE AND DISABLE METHOD

BRIEF DESCRIPTION OF THE DRAWINGS

For a more complete understanding of the disclosure, reference should be made to the following detailed description and accompanying drawings wherein.

Figure 1:
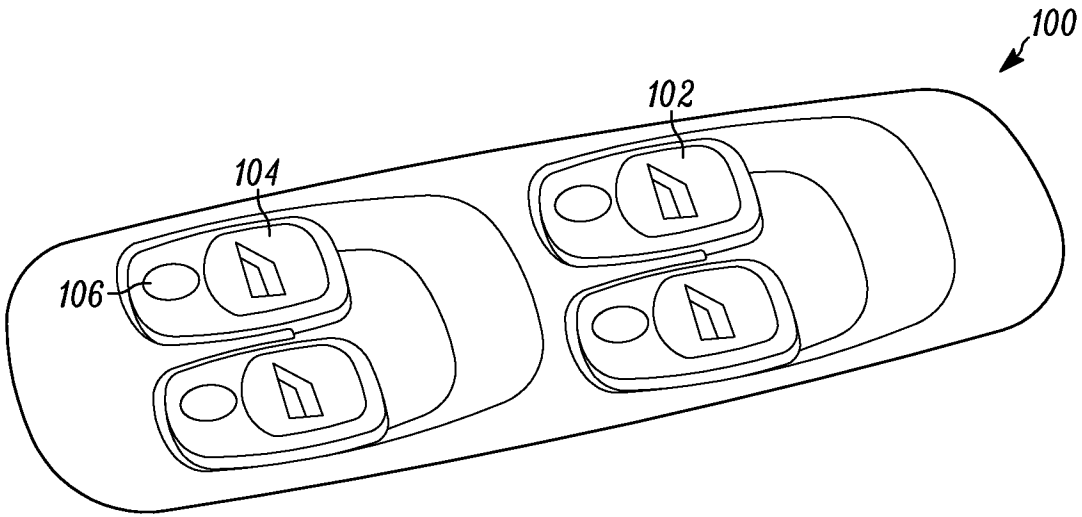
FIG. 1 comprises a schematic pictorial view of an exemplary control panel.

Skilled artisans will appreciate that elements in the figures are illustrated for simplicity and clarity and have not necessarily been drawn to scale. For example, the size dimensions and/or relative positioning of some of the elements in the figures may be exaggerated relative to other elements to help to improve understanding of various aspects of the present invention. Also, common but well-understood elements that are useful or necessary in a commercially feasible embodiment are often not depicted in order to facilitate a less obstructed view of these various aspects of the present invention. Furthermore, it will be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Power windows are now commonly offered in many motor vehicles such as automobiles and trucks. The vehicle power windows are typically operated by vehicle occupants via controls, such as for example, pushbutton- or rocker-actuated open/close switches. The controls are typically provided in control panels commonly mounted on the insides of the doors or in proximity to center line of the vehicle, enabling the vehicle operator or passengers to selectively actuate the opening or closing of individual windows.

In addition to the individual window open/close switches for each window, many vehicles equipped with power windows often feature a lock-out switch that enables and disables the closing or opening of all of the windows in the vehicle except for the vehicle operator's window. The lock-out switch is typically provided in a centralized location, such as the vehicle operator's control panel. Thus, if for safety reasons or otherwise, the vehicle operator disables a rear window via the lock-out switch, the vehicle operator will also at the same time disable the other rear windows and the passenger side window. Conversely, if a passenger wants to open or close the passenger side window and the vehicle operator grants that passenger control via the lock-out switch, any other passengers, for example infants or common household pets, will also gain the ability to control their windows at the same time, which may not be desirable due to the other passengers' potential lack of discretion.

However, in some vehicular power window applications, the window controls are typically communicatively coupled to a controller rather than directly to the window actuators. The controller is in turn communicatively coupled to the window actuators. Thus, the controller receives and interprets requests from the window controls and in response commands the window actuators accordingly. Because the controller is interposed between the window controls and the window actuators, it is possible to define a request sequence to instruct the controller to enable or disable windows in the vehicle using only open/close switches, thus reducing the need for a window lock-out switch. Moreover, it is possible and desirable to enable and disable individual windows. Furthermore, while certain design consideration may call for such functionality to be accessible only at a centralized location, for example through the vehicle operator's window control panel, it may also be desirable to permit the windows to be enabled or disabled from other locations, for example from window control panels near the windows' respective individual locations and more specifically through individual door window control panels.

Figure 4:
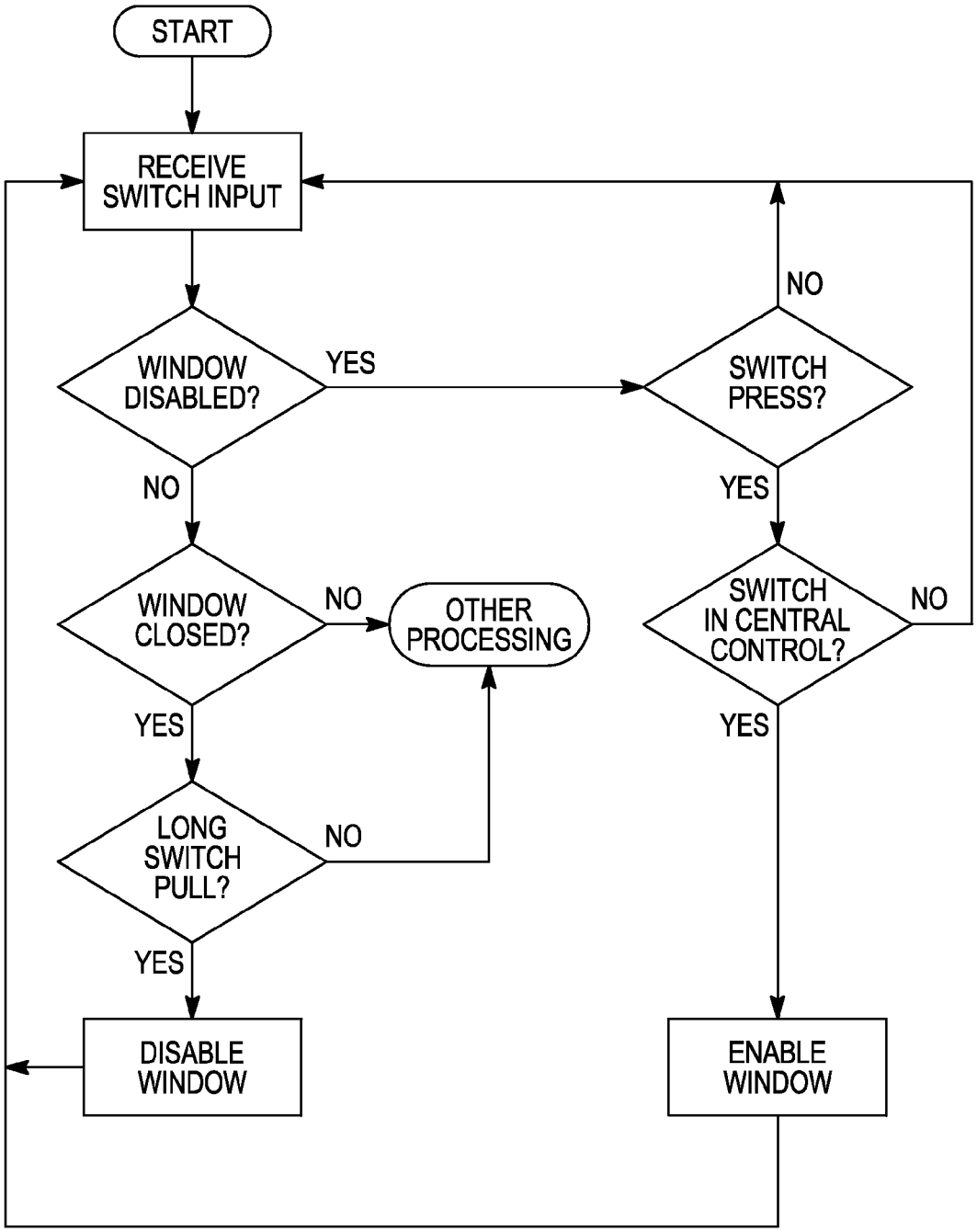
FIGS. 4-5 comprise schematic diagrams of exemplary methods.

With reference to FIG. 4, in an example, a window is disabled when, with the window in the closed position, a sequence containing a request to close the window, for example pulling up on the window switch for a predetermined length of time, is issued using a corresponding window control. In an aspect, the predetermined period of time is at least about 0.5 seconds, but in other aspects it may be at least about 1 second. Moreover, in some aspects, the predetermined length of time may be limited to a maximum, after which the sequence is ignored or processed as a different sequence. In some aspects the maximum is about 3 seconds.

Conversely, with continued reference to FIG. 4, issuing a sequence containing a request to open a disabled window, for example by pushing down on the corresponding window switch in a centralized location, e.g. the vehicle operator's control panel, enables the respective window. However, in another example, another instantiation of the sequence used to disable the window may also be used as a toggle to re-enable a disabled window.

Figure 5:
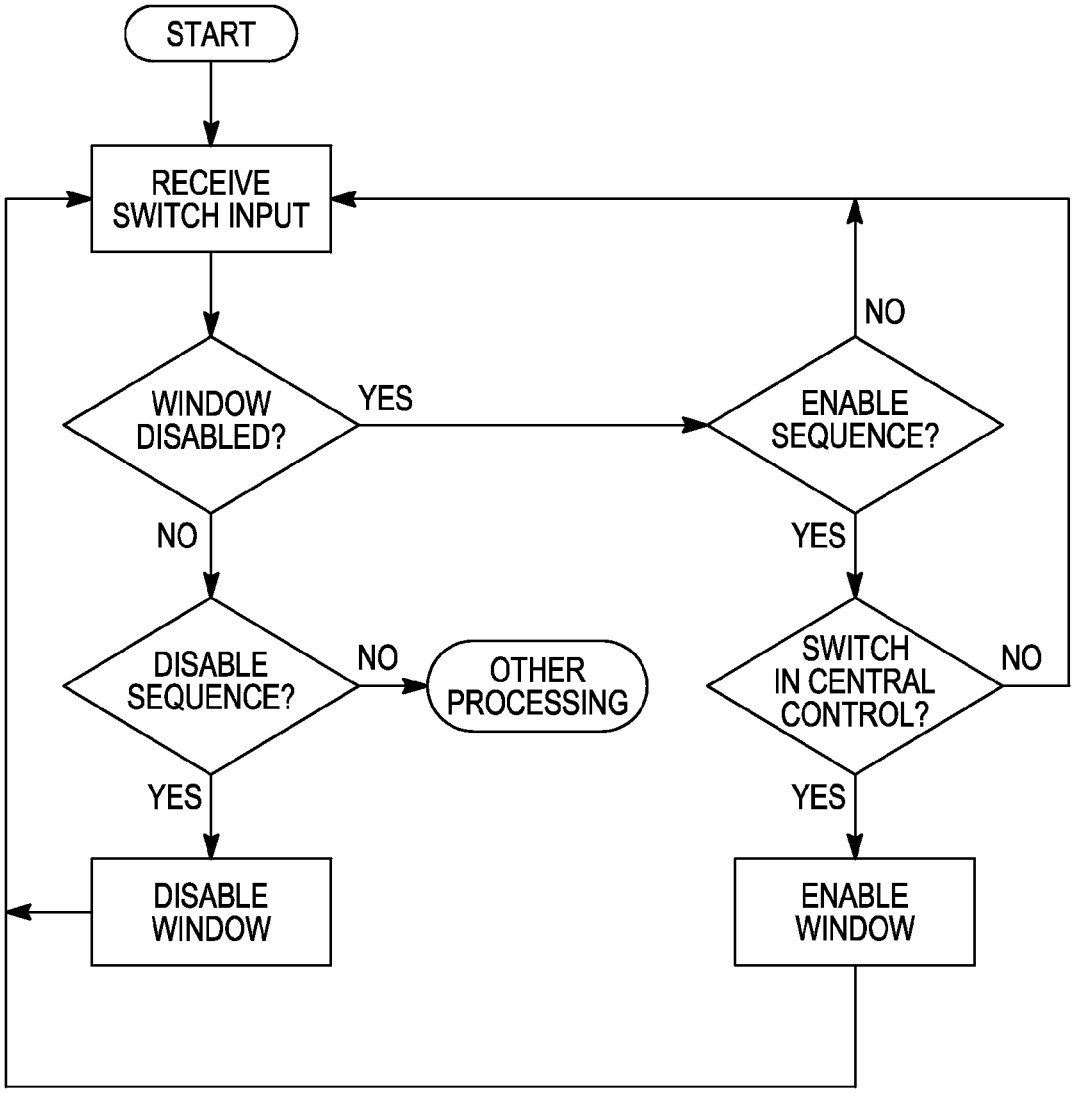

With reference to FIG. 5, in another example the request to disable the window is conveyed via a more elaborate sequence, such as for example a double pull on the switch within a predetermined period of time. Similarly, a more elaborate request sequence may also be used to enable a window. For example, a double push within a predetermined period may be used. Alternately, the same sequence may be used as a toggle for both enabling and disabling the window.

In an aspect, the predetermined period of time is at most about 0.5 seconds, but in other aspects it may be at most about 1 second, and in yet other aspects it may be at most about 3 seconds.

Using a more elaborate request sequence permits window enablement and disablement in positions other than closed or fully open, reduces unintended window enablements and disablements, and better facilitates window enablement and disablement from controls other than those in the centralized location, for example individual door window control panels near the respective windows.

A person skilled in the art will appreciate that suitable sequences other than a double pull and double push may also be used, including user configurable sequences. In one aspect, the enablement and disablement sequences are chosen so that vehicle occupants of suitable discretion, for example adult or teenage humans, may enable or disable the windows with relative ease, while the task is too difficult for other occupants, for example infants or common household pets. In some aspects, a potentially counterintuitive sequence, such as a quick double pull as a toggle between enabled and disabled may be sufficiently difficult.

Accordingly, in some examples, the enablement or disablement sequences may be used from controls near the windows' individual locations, for example individual door window control panels, to enable or disable the respective individual windows.

However, since disabling the vehicle operator window is often not desirable, in some examples the sequences used on the vehicle operator's window control disable and enable all or some subset of the remaining windows or to override the ability to enable or disable windows from individual control panels, to provide the functionality thus far provided by a separate lock-out switch.

Furthermore with reference to FIG. 1, an exemplary control panel 100 comprises one or more controls 102, 104, wherein the controls are configured transmit sequences containing requests to at least one of open and close the respective window. In an example, the vehicle operator's window control 102 is configured to transmit sequences respective the vehicle operator's window, whereas the rear left window control is configured to transmit sequences respective the rear left window. In an example, controls are configured to transmit sequences respective other movable structures used to open and close an aperture in a vehicle.

In an example, the enabled and disabled status of each movable structure is indicated by a respective visual indicator 106, for example a bi-color or lit/unlit LED, located in the proximity of the respective control 104, in the respective control 104 itself, or otherwise. In an aspect green or unlit visual indicator 104 indicates that the window is enabled and red or lit indicator 104 indicates that the window is disabled. However, a person skilled in the art will appreciate that a number of other notification schemes are possible, including different colors and different light/dark patterns.

Figure 2:
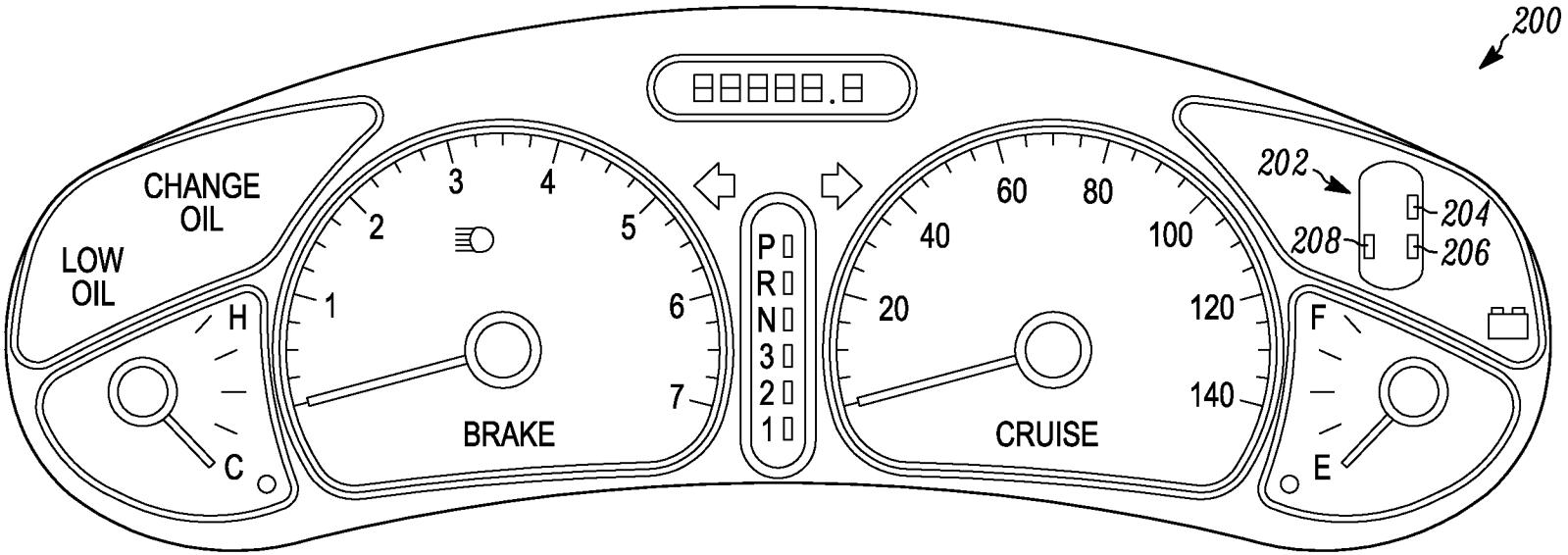
FIG. 2 comprises a schematic pictorial view of an exemplary instrument cluster.
Figure 3:
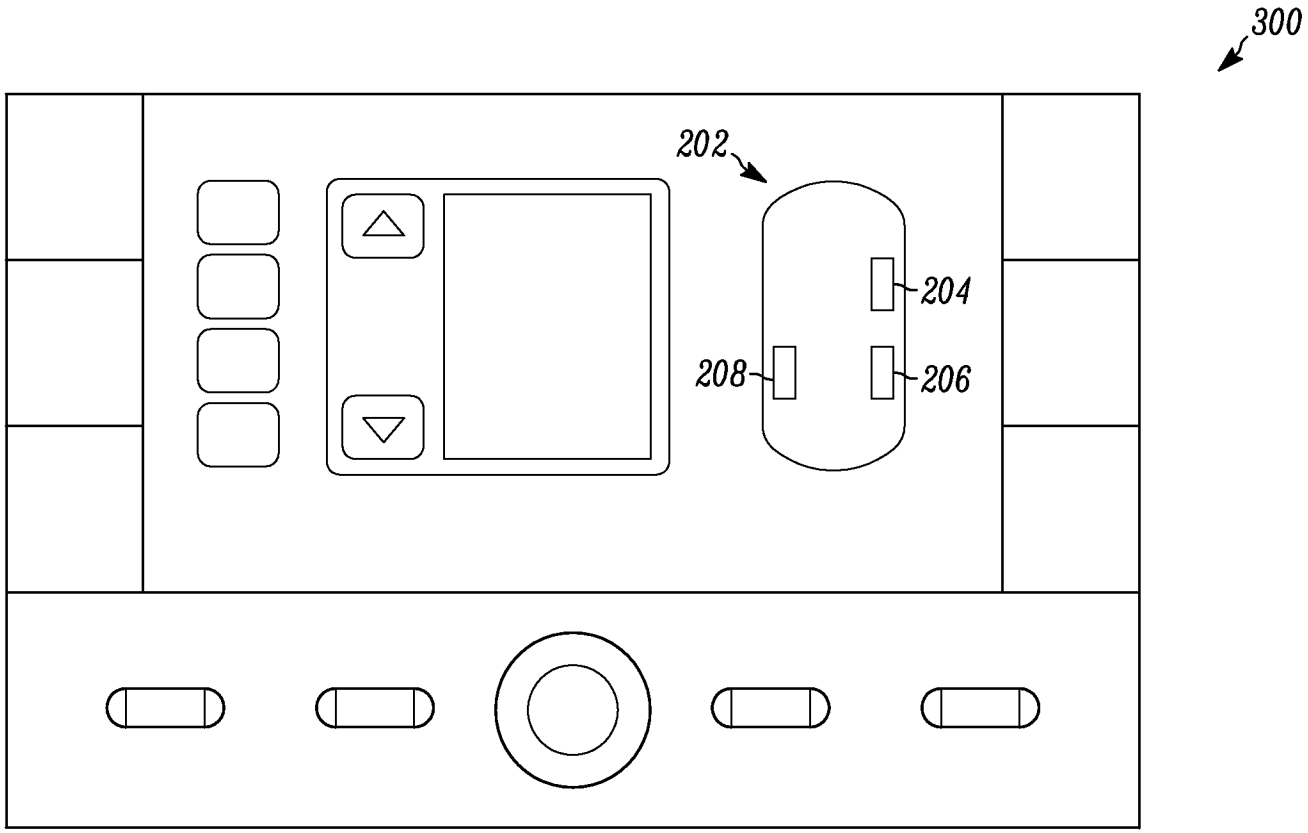
FIG. 3 comprises a schematic pictorial view of an exemplary center stack.

Also, with reference to FIGS. 2 and 3, in an example, the feedback of the enabled and disabled status of each window is indicated by the respective visual indicators 204-208 in a vehicle operator information center 202 in the instrument cluster 200, in the center stack 300, or otherwise.

In an example, at least one control 102 or 104 is communicatively coupled to a controller. In an aspect, the controller is configured to receive a sequence containing a request to at least one of open and close the aperture from at least one control 102 or 104, interpret the received sequence as a request to one of enable and disable the actuation of the moveable structure, and in response to the interpretation, one of enable or disable the actuation of the moveable structure. In an aspect the controller is configured to communicate the enabled and disabled status of each moveable structure to the respective visual indicator.

In an aspect the controller comprises at least one processor and a computer storage medium. In an aspect the computer storage medium is configured to store instructions executable by one or more processors to receive a sequence containing a request to at least one of open and close the aperture from at least one control, interpret the received sequence as a request to one of enable and disable the actuation of the moveable structure, and in response to the interpretation, one of enable or disable the actuation of the moveable structure. In an aspect the computer storage medium is configured to store instructions executable by one or more processors to communicate the enabled and disabled status of each moveable structure to the respective visual indicator.

In an aspect the controller is communicatively coupled to a body control module. In another aspect the controller is comprised in a body control module. In an aspect the controller is communicatively coupled to the moveable structure actuator.

In an example the controller is disposed within a vehicle. In an aspect the controller is configured to control the actuation of a movable structure used to open and close an aperture in the vehicle.

Although the above examples have been described with respect to an exemplary window, in an aspect, analogous modes of operation are available for every movable structure used to open and close an aperture in a vehicle for which the enable/disable feature may be desirable and for which controls analogous to power window controls are available, for example the rear windows, the passenger window, the moon roof, all or some subset of vehicle windows, power locks, and power doors.

Those skilled in the art will recognize that a wide variety of modifications, alterations, and combinations can be made with respect to the above described embodiments without departing from the spirit and scope of the invention, and that such modifications, alterations, and combinations are to be viewed as being within the scope of the invention. Further, those skilled in the art will recognize that the approaches described herein may also be used to control components and devices other than movable structures used to open and close apertures in a vehicle.

What is claimed is:

1. A method for controlling the actuation of a movable structure used to open and close an aperture in a vehicle, the method comprising:

receiving at a controller a sequence indicative of at least one actuation of at least one of open and close control communicatively coupled to the controller, mounted in the vehicle and corresponding to the movable structure wherein the movable structure is a window, the control being manually physically actuated by a vehicle occupant, the sequence containing a request to at least one of open and close the aperture and being too difficult to be issued by infants and common household pets, wherein being too difficult to be issued by infants and common household pets comprises being issued by an actuation comprising at least one of a double pull and a double push on an open and close control switch within a predetermined period of time;

interpreting the sequence as a request to one of enable and disable the actuation of the movable structure;

in response to the interpretation, one of enabling and disabling the actuation of the movable structure.

2. The method as recited in claim 1, wherein the sequence comprises a request to close the aperture while the aperture is already closed.

3. The method as recited in claim 1, wherein the sequence comprises a request to open the aperture and the sequence is received from the control in a centralized location.

4. The method as recited in claim 1, wherein the sequence comprises at least two requests to one of open and close the aperture within a predetermined time period.

5. The method as recited in claim 4, wherein the time period is at most about 3 seconds long.

6. The method as recited in claim 4, wherein the time period is at most about 1 second long.

7. The method as recited in claim 4, wherein the time period is at most 0.5 seconds long.

8. The method as recited in claim 1, wherein the sequence is at least about 0.5 seconds long.

9. The method as recited in claim 1, wherein the sequence is at least about 1 second long.

10. The method as recited in claim 1, wherein the sequence is at most about 3 seconds long.

11. The method as recited in claim 1 wherein the one of enabling and disabling the actuation of the movable structure comprises one of enabling and disabling of a first movable structure in response to actuation of at least one of open and close control corresponding to a movable structure associated with a vehicle operator's station, and one of enabling and disabling of a second movable structure in response to actuation at least one of open and close control corresponding to the second movable structure, the first and second movable structures being different from the movable structure associated with the vehicle operator's station, and the one of open and close controls corresponding to the first and second movable structures being different from the one of open and close control corresponding to the movable structure associated with the vehicle operator's station.

12. The method as recited in claim 1 wherein the control comprises an open/close power window switch.

13. An apparatus for controlling the actuation of a movable structure used to open and close an aperture in a vehicle, the apparatus comprising:

a controller, the controller comprising a processor and a computer storage medium, the controller configured to receive a sequence indicative of at least one actuation of at least one of open and close control communicatively coupled to the controller, mounted in the vehicle and corresponding to the movable structure, wherein the movable structure is a window, the control being manually physically actuated by a vehicle occupant, the sequence containing a request to at least one of open and close the aperture and being too difficult to be issued by infants and common household pets, wherein being too difficult to be issued by infants and common household pets comprises being issued by an actuation comprising at least one of a double pull and a double push on an open and close control switch within a predetermined period of time, interpret the received sequence as a request to one of enable and disable the actuation of the movable structure, and in response to the interpretation, one of enable or disable the actuation of the movable structure.

14. The apparatus as recited in claim 13, wherein the sequence comprises a request to close the aperture while the aperture is already closed.

15. The apparatus as recited in claim 13, wherein the sequence comprises a request to open the aperture and the sequence is received from the control in a centralized location.

16. The apparatus as recited in claim 13, wherein the sequence comprises at least two requests to one of open and close the aperture within a predetermined time period.

17. The apparatus as recited in claim 13, wherein the controller is configured to communicate at least one of enabled and disabled status the movable structure to a visual indicator.

18. A system for controlling the actuation of a movable structure used to open and close an aperture, the system comprising:

a vehicle defining at least one aperture and comprising at least one movable structure used to open and close the aperture and at least one control configured to communicate a sequence indicative of at least one actuation of at least one of open and close control mounted in the vehicle and corresponding to the movable structure, wherein the movable structure is a window, the control being manually physically actuated by a vehicle occupant, the sequence comprising a request to at least one of open and close the aperture and being too difficult to be issued by infants and common household pets, wherein being too difficult to be issued by infants and common household pets comprises being issued by an actuation comprising at least one of a double pull and a double push on an open and close control switch within a predetermined period of time; and a controller disposed within the vehicle, the controller configured to receive a sequence containing a request to at least one of open and close the aperture from the control communicatively coupled thereto, interpret the received sequence as a request to one of enable and disable the actuation of the movable structure, and in response to the interpretation one of enable or disable the actuation of the movable structure.

19. The system as recited in claim 18, wherein the sequence comprises a request to close the aperture while the aperture is already closed.

20. The system as recited in claim 18, wherein the sequence comprises a request to open the aperture and the sequence is received from the control in a centralized location.

21. The system as recited in claim 18, wherein the sequence comprises at least two requests to one of open and close the aperture within a predetermined time period.

* * * * *